US005490771A

United States Patent [19]

Wehber et al.

[11] Patent Number: 5,490,771

[45] Date of Patent: Feb. 13, 1996

[54] EXTERNAL, SHAFT BEARING ARRANGEMENT, FOR A ROTARY GAS COMPRESSOR

[75] Inventors: Wayne F. Wehber, Horseheads; Charles E. Seavey, Painted Post; James R. Griggs, Elmira, all of N.Y.

[73] Assignee: Dresser-Rand Company, Corning, N.Y.

[21] Appl. No.: 270,881

[22] Filed: Jul. 5, 1994

[51] Int. Cl.[6] ..... F04C 18/18

[52] U.S. Cl. ..... 418/104; 417/63

[58] Field of Search ..... 418/104; 417/435, 417/63

[56] References Cited

U.S. PATENT DOCUMENTS 4,993,930 2/1991 Uchida ..... 418/104

5,322,428 6/1994 Hansen et al. ..... 418/104 X 5,338,167 8/1994 Berges ..... 418/104

*Primary Examiner*—Richard E. Gluck

*Attorney, Agent, or Firm*—Bernard J. Murphy

[57] ABSTRACT

In a rotary gas compressor which has a compression housing, in which the gas compressing elements are operatively confined, a shaft and bearing housing is provided. The latter housing is removably coupled to an end of the compression housing, and supports therein the rotary shaft and the bearings therefor. The bearings are located in a portion of the shaft and bearing housing which is outboard or external of the compression housing. A coolant chamber is set abut the shaft and bearing housing whereat the bearings are located. The latter housing further has apertures formed therein to visually expose the shaft, as well as for discharging therethrough any leaking lubricant.

9 Claims, 3 Drawing Sheets

EXTERNAL, SHAFT BEARING ARRANGEMENT, FOR A ROTARY GAS COMPRESSOR

This invention pertains to gas compressors, of the rotary type, and in particular to an arrangement for externally positioning the shaft bearings thereof.

In prior art, rotary gas compressors, it is common for the shaft-supporting bearings to be enclosed within a common housing with the gas compressing elements, i.e. meshing rotors, or whatever. Such an arrangment, however, presents problems. For one, it is difficult to provide adequate cooling of the shaft-supporting bearings, as they are so intimate with the heated compression chamber. Too, leakages are problematical. Sealing between the grease and/or oil provided for the bearings, and the product gas is difficult, and entails considerable expense. As there is one, common housing, little facility presents itself for (a) securely sealing in the product gas, and (b) venting any leaking lubricant. Further, no practical means can be provided which adequately exposes the shaft, sealing means, and the like, to visual inspection without a disassembly of some or all of the compressor. More, bearing replacement has to entail at least an entry into the one, common housing and a concomitant disturbance of the inner sealing means.

It is an object of this invention to set forth a novel, external, shaft bearing arrangement, for a rotary gas compressor, which obviates the aforementioned problems.

Particularly, it is an object of this invention to disclose an external, shaft bearing arrangement, for a rotary compressor, comprising a gas compression housing; a shaft and bearing housing coupled to said compression housing; a shaft journalled in said shaft and bearing housing; and bearing means, for rotatably supporting said shaft, mounted within a portion of said shaft and bearing housing; and wherein said portion of said shaft and bearing housing is external of said compression housing.

Further objects of this invention, as well as the novel features thereof, will become apparent by reference to the following description, taken in conjunction with the accompanying figures, in which.

Figure 1:
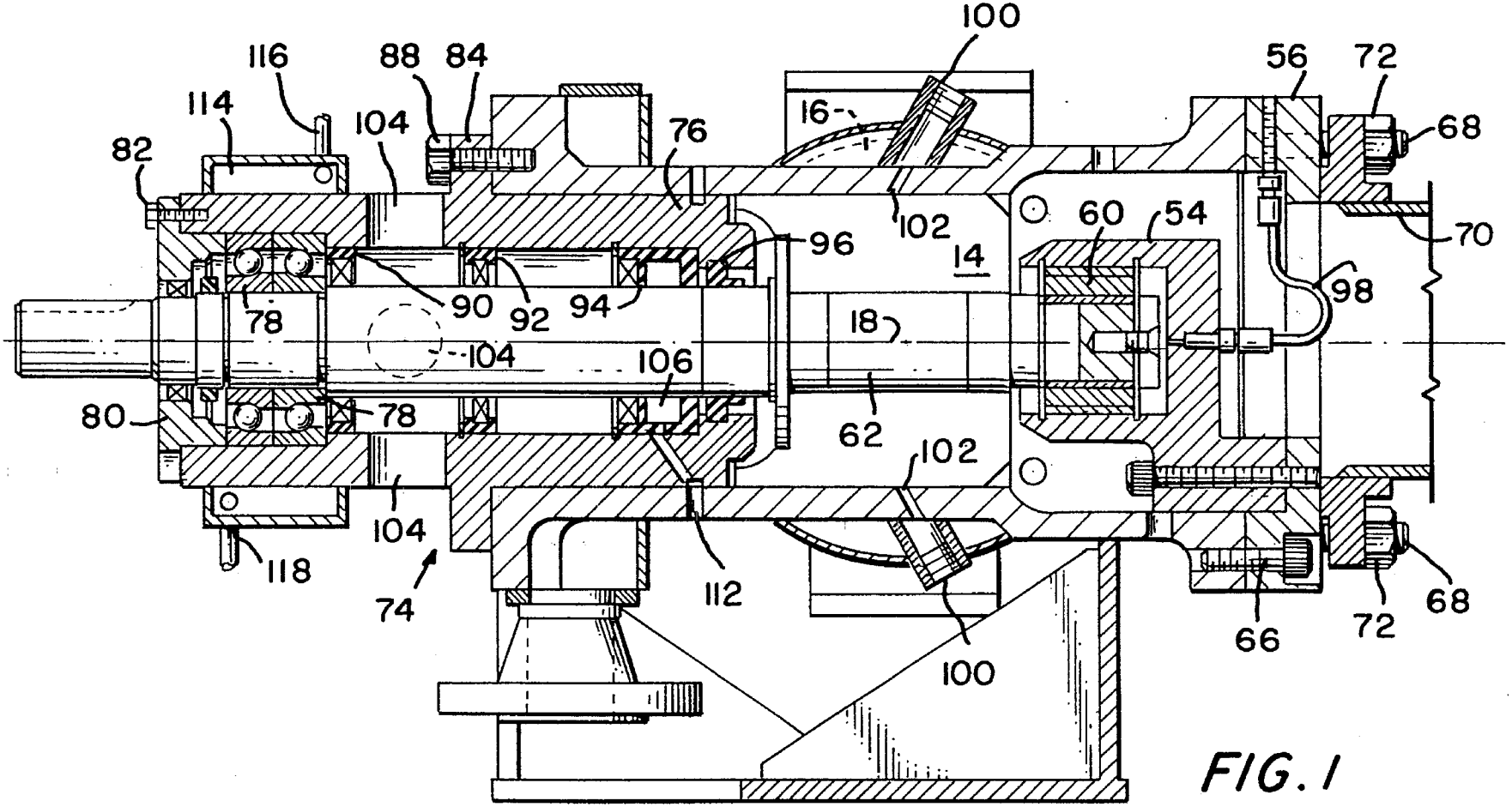
FIG. 1 is a cross-sectional view of a single screw, rotary compressor, taken along the rotary axis of the screw, which incorporates an embodiment of the invention.
Figure 2:
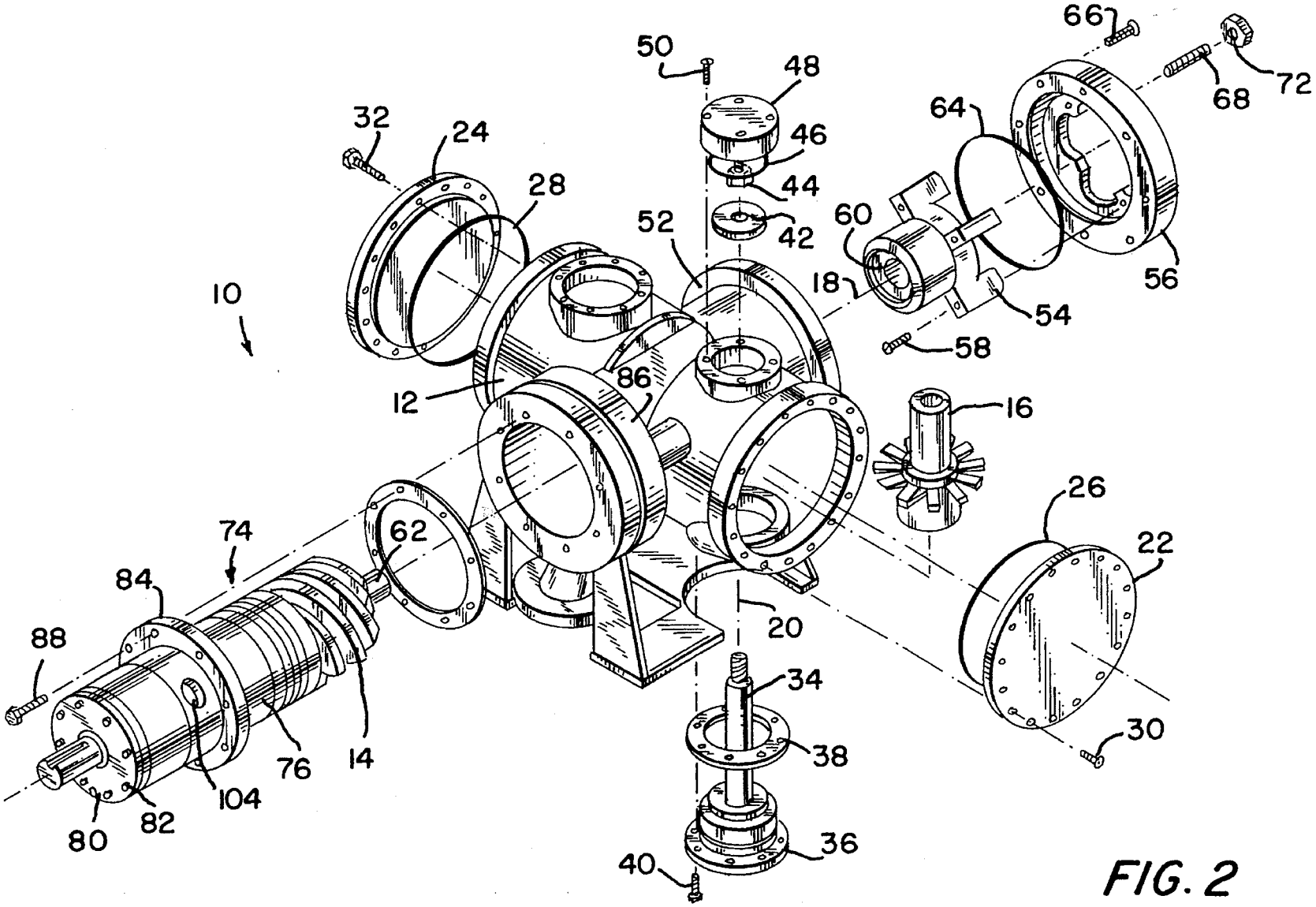
FIG. 2 is an exploded view of the compressor of FIG. 1 in which, however, the coolant chamber, and the lubricant feed to the front bushing are not shown.
Figure 3:
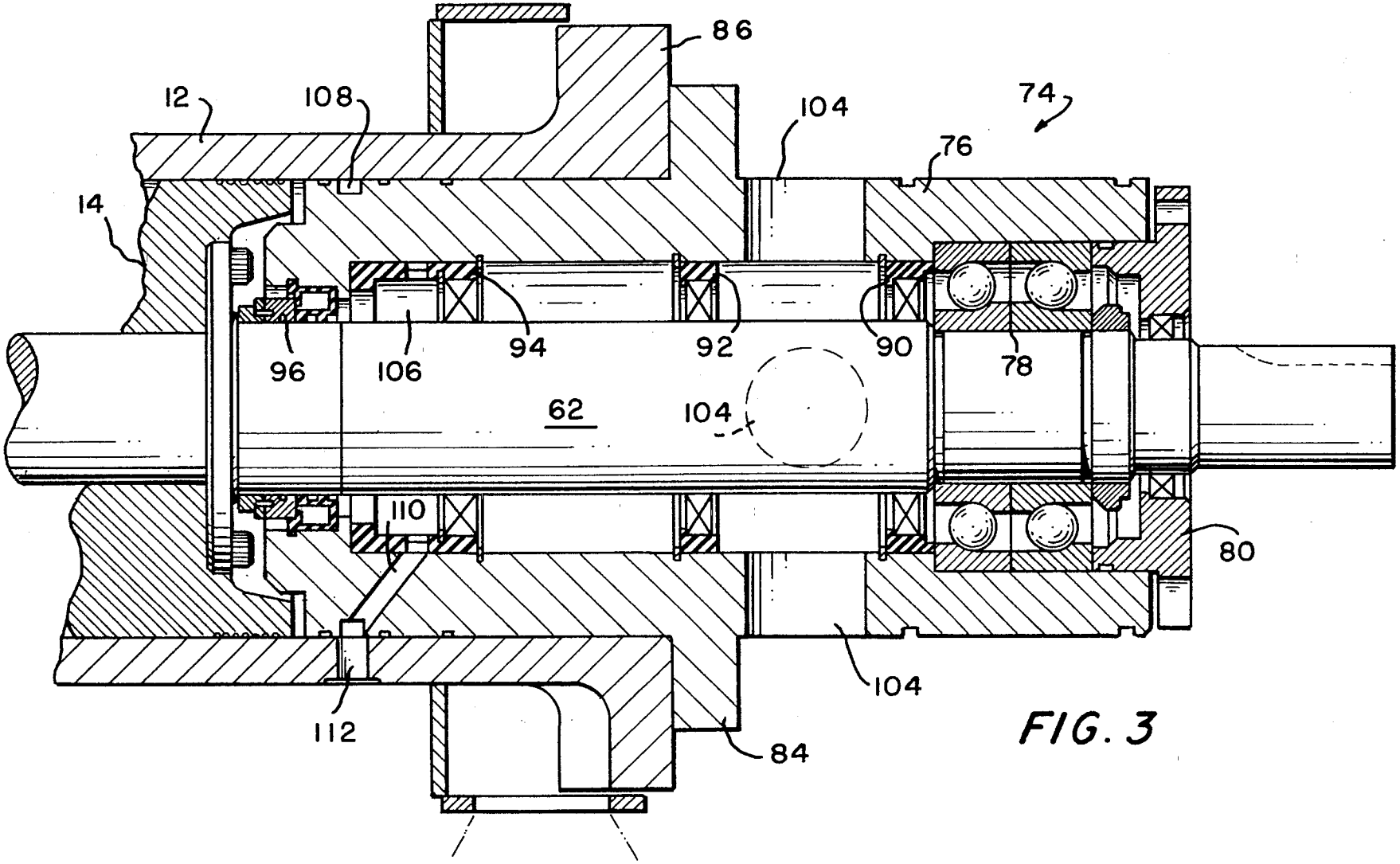
FIG. 3 is an enlarged, fragmentary cross-section, corresponding to the FIG. 1 cross-section, showing the shaft and bearing housing in greater detail. Here too, the coolant chamber has been omitted.

As shown in the figures, the compressor 10 is of the single screw, rotary type, and has a compression housing 12 which confines operatively therein the screw 14 and the interengaging gate rotor 16. Screw 14 rotates abut an axis 18, and the gate rotor 16 rotates about an axis 20. Sides of the housing 12 are sealed off by closure plates 22 and 24 and sealing rings 26 and 28, the plates being fastened by hardware 30 and 32. The gate rotor 16 is journalled on a shaft 34 which is coupled to a closure-support 36; the latter is secured to the housing 12, with an intervening sealing gasket 38, by hardware 40. The extending end of the shaft 34 receives a washer 42, a nut 44, a sealing ring 46, and a closure cap 48. Hardware 50 secures the cap 48 to the housing 12.

The inlet end 52 of the housing 12 receives therein a multi-limbed shaft support 54. The support 54 is fastened to an outer annulus 56 by hardware 58, and has a bushing 60 secured therein in which to receive the inner end of the screw-mounting shaft 62. With an intervening seal 64, the annulus 56 is fastened to inlet end 52 by means of machine screws 66. Studs 68 are received in tapped holes in the outer end of the annulus 56 for mounting thereto an inlet duct 70 with nuts 72.

Screw 14 and shaft 62 comprises components of a self-contained screw and shaft and bearing housing subassembly 74. Subassembly 74 comprises a shaft and bearing housing 76 in which the screw-supporting shaft 62 is journalled. An outer end of the shaft and bearing housing 76 confines therewithin a pair of bearings 78, the same being fixed in the housing 76 by a closure 80 which is fastened to the housing 76 by hardware 82. Housing 76 has a flange 84 which abuts, and is fastened to, an annulus 86 of the housing 12 by fasteners 88. Confined within the housing 76, and spaced apart therein, are seals 90, 92, 94 and 96. The same are set abut the shaft 62 (a) to prevent the product gas from passing into the area of the housing 76 where the bearings 78 are located, and (b) to prevent any bearing lubricant from migrating into the compression chamber of the housing 12. As FIG. 1 shows, the inlet end of the housing 12, and via annulus 56, has a lubricant feed conduit 98 for supplying lubricant to the shaft-receiving bushing 60. Fittings 100 communicate with diagonally formed passageways 102 formed in the housing 12 for the purpose of admitting a sealing, liquid injection to the screw 14.

Intermediate the length thereof, the shaft and bearing housing 76 has a plurality of apertures 104 formed therein. The same accommodate for a visual inspection of the shaft 62, and seals 90 and 92, and permit observation, therefore, of any unwarranted lubricant leakage thereat. Seals 94 and 96 cooperate with the housing 76 to define a chamber 106 therebetween. Too, the housing 76 has an annular groove 108 formed in the outer surface thereof, and a throughgoing passageway 110 which communicates the chamber 106 with the groove 108. In addition, the housing 12 has a port 112 formed through the wall thereof which aligns with passageway 110. This arrangement insures a venting of the chamber 106 of any product gas which insinuates itself past the seal 96. Similarly, the apertures 104, besides affording visual inspection of the inside of the housing 76, present a means for the evacuation of any bearing lubricant which happens to migrate past the seal 90, and the venting of any product gas in the case of gross leakage thereof past seals 92, 94 and 96.

As the bearing-confining portion of the housing 76 is outboard or external of the housing 12, the bearings 78 are not exposed to the heat of the compression which occurs in the housing 12. Additionally, it accommodates a coolant chamber 114, with coolant admitting and discharging conduits 116 and 118, thereabout, as shown in FIG. 1.

While we have described our invention in connection with a specific embodiment thereof, it is to be clearly understood that this is done only by way of example, and not as a limitation to the scope of the invention as set forth in the objects thereof, and in the appended claims.

We claim:

1. An external, shaft bearing arrangement, for a rotary gas compressor, comprising:

a gas compression housing;

a shaft and bearing housing being partially inserted in said compression housing;

a shaft journalled in said shaft and bearing housing; and bearing means, for rotatably supporting said shaft; mounted within a portion of said shaft and bearing housing; and wherein said portion of said shaft and bearing housing is external of said compression housing.

2. An external, shaft bearing arrangement, according to claim 1, further including:

sealing means, confined within said shaft and bearing housing, for preventing fluid communication between said housings.

3. An external, shaft bearing arrangement, according to claim 2, wherein:

said shaft and bearing housing has means, intermediate said sealing means and said bearing means, for venting lubricant therethrough.

4. An external, shaft bearing arrangement, according to claim 1, wherein:

said shaft and bearing housing has means, coupled to said portion thereof, for cooling said bearing means.

5. An external, shaft bearing arrangement, according to claim 2, wherein:

said sealing means comprises a plurality of spaced-apart seals.

6. An external, shaft bearing arrangement, according to claim 2, wherein:

said shaft and bearing housing has means formed therein for venting lubricant therethrough; and said sealing means comprises a pair of seals set astride, and in proximate adjacency to, said venting means.

7. An external, shaft bearing arrangement, according to claim 2, wherein:

said shaft and bearing housing has means formed therein for accommodating visual observation of said shaft.

8. An external, shaft bearing arrangement, according to claim 2, wherein:

said sealing means comprises a pair of seals which cooperate with said shaft and bearing housing to define a chamber therebetween; and further including means formed in said housings for venting fluid from said chamber.

9. An external, shaft bearing arrangement, according to claim 8, wherein:

said fluid venting means comprises (a) an annular groove formed in an external surface of said shaft and bearing housing, (b) at least one vent hole formed in said compression housing and in alignment with said groove, and (c) a passageway formed in said shaft and bearing housing which opens, at one end thereof, onto said chamber, and at the opposite end thereof onto said groove.

* * * * *